US006063210A

United States Patent [19]

Chakrabarti et al.

[11] Patent Number: 6,063,210

[45] Date of Patent: May 16, 2000

[54] SUPERPLASTICALLY-FORMABLE AL-MG-SI PRODUCT AND METHOD

[75] Inventors: Dhruba J. Chakrabarti, Export; Roger D. Doherty, Wynnewood, both of Pa.

[73] Assignee: Aluminum Company of America, Pittsburgh, Pa.

[21] Appl. No.: 08/919,869

[22] Filed: Aug. 28, 1997

[51] Int. Cl.[7] ..... C22C 21/08

[52] U.S. Cl. ..... 148/415; 148/417; 148/439; 148/440; 420/535; 420/544; 420/546; 420/902

[58] Field of Search ..... 148/415, 417, 148/439, 440; 420/533, 535, 543, 544, 546, 902

[56] References Cited

U.S. PATENT DOCUMENTS 4,531,977 7/1985 Mishima et al. ..... 420/902

4,645,543 2/1987 Watanabe et al. ..... 148/439

*Primary Examiner*—George Wyszomierski

*Attorney, Agent, or Firm*—Gary P. Topolosky

[57] ABSTRACT

A superplastically formable, aluminum alloy product which consists essentially of about 2–10 wt. % magnesium; at least one dispersoid-forming element selected from the group consisting of: up to about 1.6 wt. % manganese, up to about 0.2 wt. % zirconium, and up to about 0.3 w. % chromium; at least one nucleation-enhancing element for recrystallization selected from: up to about 1.0 wt. % silicon, up to about 1.5 wt. % copper, and combinations thereof. Said alloy product has greater than about 300% elongation at a strain rate of at least about 0.0003/sec and a superplastic forming temperature between about 1000–1100° F. due, in part, to the preferred thermomechanical processing steps subsequently applied thereto. A related method of manufacture is also disclosed herein.

19 Claims, 4 Drawing Sheets

SUPERPLASTICALLY-FORMABLE AL-MG-SI PRODUCT AND METHOD

BACKGROUND OF THE INVENTION

1. Field of the Invention

This invention relates to the field of superplastically formable aluminum alloys, and more particularly to means for imparting superplastic formability to aluminum alloys with relatively lower magnesium concentrations, i.e., those with about 4 wt. % magnesium or less. The invention further relates to an improved sheet product made from said alloys, said sheet product having improved corrosion resistance thereby making it more suitable for use in numerous applications, especially those in the automotive field.

2. Technology Review

Numerous approaches are known for enhancing superplastic formability. Some are directed to manipulations in the superplastic forming operation to enhance said operation or alleviate problems associated with it largely by controlling the flow of metal during forming. Representative examples of such manipulations are shown in U.S. Pat. Nos. 3,997,369, 4,045,986, 4,181,000 and U.S. Pat. No. 4,516, 419. Another approach is directed to the metal to be superplastically formed. It has long been recognized that fine grain size enhances forming operations, including superplastic forming. Some efforts to achieve fine grain size are shown in U.S. Pat. Nos. 3,847,681 and 4,092,181. More recently, U.S. Pat. No. 5,055,257 taught adding scandium and zirconium to certain aluminum alloys for achieving SPF properties in 7050-type alloys.

There are several known ways for achieving superplastic formability in aluminum alloys with relatively higher magnesium contents, i.e. generally above 4 wt. % Mg. For Al sheet products containing about 4.5 wt. % or higher Mg, even up to about 10% Mg, the Zr, Cr and/or Mn dispersoids that are usually present develop superplastic forming (SPF) capabilities with elongations of about 400–550% at moderately fast strain rates of about $2\times10^{-3}$/sec or more when subjected to certain thermomechanical process (or "TMP") combinations. The latter rates are similar to the relatively fast strain rates available for a commercial SPF aluminum alloy sold by Superform USA Inc., under the mark Supral®.

Al alloys with magnesium contents of about 3 wt. % have superior corrosion resistance compared to their higher Mg (4.5 wt. % and above) counterparts, thus making lower magnesium-containing, aluminum alloys attractive for many automotive part applications, especially when such parts can be made by superplastic forming ("SPF") to achieve part consolidation. When subjected to identical TMP conditions as those described above for higher Mg alloys, however, an Al-3% Mg alloy resulted in a maximum elongation of only about 208%. There is a current need to develop an SPF Al—Mg for possible automotive parts consolidations. Most efforts have centered around 4.5% Mg compositions because of automakers' and researchers' past familiarity with 5083 and 5182 alloy performance, an SPF alloy with only about 3% Mg would be preferred in spite of its somewhat reduced strength, since such lower Mg alloys are less susceptible to intergranular corrosion when exposed to paint bake temperatures unlike their Al-4.5 Mg counterparts. Such a development could provide a differentiated product for possible use in both inner part and outer panel automotive applications. Said products would have superior corrosion resistance coupled with high SPF formability. This invention addresses recent efforts to achieve good SPF elongations, in excess of about 400%, and more preferably 500% or higher, for about 88% cold rolled sheet at about 1050° F. using a moderately high strain rate of about 0.001/sec. The results obtained herein compare favorably with SPF results reported in the literature for the 4.5% Mg-based 5083 and 5182 aluminum alloys favored by today's automotive manufacturers and designers. It is believed that the same procedures described below for a new Al-3% Mg SPF product could also enhance the performance of higher Mg-containing alloys, including Al-4.5% Mg alloys.

SUMMARY OF THE INVENTION

It is a principal objective of this invention to provide a lower Mg, aluminum-based alloy with superplastic formability, more preferably with improved corrosion resistance. It is another main objective to provide a method for imparting superplastic formability to a greater range of Al alloys containing less than about 6 wt. % Mg, and more preferably, less than about 4 wt. % magnesium. It is another main objective herein to provide for automotive sheet manufacturers, an improved product and method for exploiting the superplastic formability of lower Mg, aluminum alloys. These, and other objectives are achieved with a superplastically formable, aluminum alloy product which consists essentially of: about 2–10 wt. % magnesium; at least one dispersoid-forming element selected from the group consisting of: up to about 1.6 wt. % manganese, up to about 0.2 wt. % zirconium, and up to about 0.3 w. % chromium; at least one nucleation-enhancing element for recrystallization selected from: up to about 1.0 wt. % silicon, up to about 1.5 wt. % copper, and combinations thereof Said alloy product has greater than about 225% elongation at a strain rate of at least about 0.0003/sec and a superplastic forming temperature between about 950–1135° F. due, in part, to the preferred thermomechanical processing steps subsequently applied thereto. A related method of manufacture is also disclosed herein.

BRIEF DESCRIPTION OF THE DRAWINGS

Further features, objectives and advantages of this invention will be made clearer from the following detailed description of preferred embodiments made with reference to the accompanying charts, drawings and micrographs in which:

(FIG. 3*a*) versus 1050° F. (FIG. 3B) and a strain rate of 0.001/sec.

DETAILED DESCRIPTION OF PREFERRED EMBODIMENTS

Figure 1A:
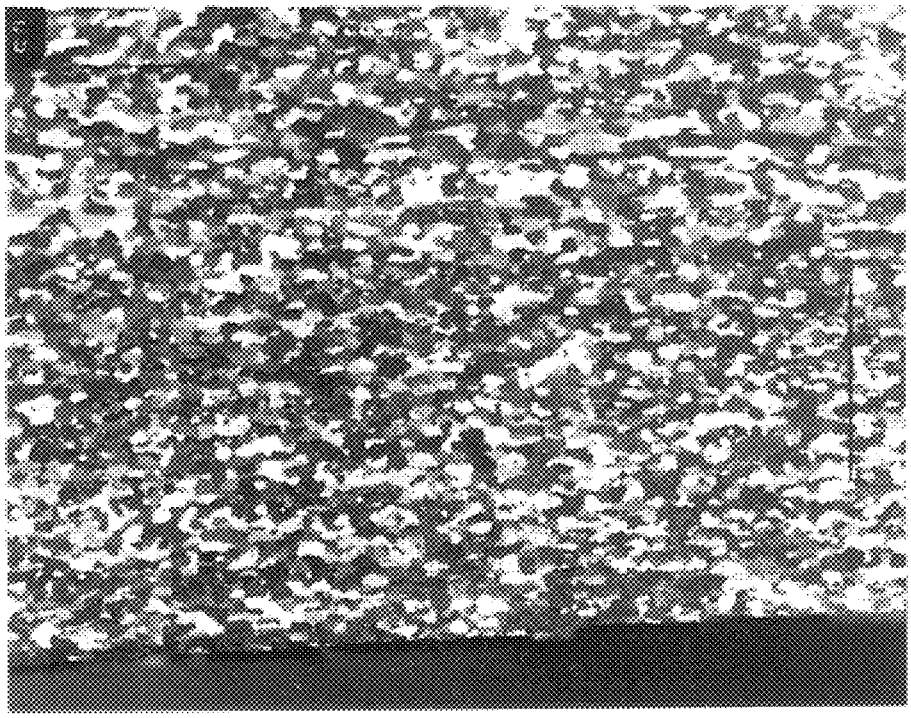
FIGS. 1A and 1B are polarized light optimal micrographs (100× magnification) showing the grain structures of a 0.10 inch thick, superplastically formed sheet product according to this invention tested at 1000° F. and a strain rate of 0.0003/sec., FIG. 1A being at Grip and FIG. 1B at Gauge, respectively.

For any description of preferred alloy compositions, all references to percentages are by weight percent (wt. %) unless otherwise indicated.

When referring to any numerical range of values, such ranges are understood to include each and every number and/or fraction between the stated range minimum and maximum. A range of about 2–10 wt. % magnesium, for example, would expressly include all intermediate values of about 2.1, 2.2, 2.3 and 2.5 wt. %, all the way up to and including 9.95, 9.97 and 9.99 wt. % Mg. The same applies to every other elemental and/or numerical property/processing range set forth herein.

As used herein, the term "substantially-free" means having no significant amount of that component purposefully added to the alloy composition, it being understood that trace amounts of incidental elements and/or impurities may find their way into a desired end product. For example, a substantially iron-free alloy might contain less than about 0.3% Fe, or less than about 0.1% Fe on a more preferred basis, due to contamination from incidental additives or through contact with certain processing and/or holding equipment. It is to be understood that the alloy composition of this invention is also generally free of any elemental components not expressly mentioned hereinabove. Particularly, this invention is free of components X, Y and Z even though it does not expressly state every single component which is absent from its preferred formulations. Furthermore, all corrosion-resistant embodiments of this present invention are substantially copper-free though it is to be understood that the invention also applies to Cu-containing alloys as needed.

The term "superplastic", as used herein, describes the forming of complex shapes from metals, especially aluminum alloys herein, at elevated temperatures and specified strain rates utilizing the superplastic forming characteristics of the metal to avoid localized necking, cavitation, tearing and other complex shape-forming problems. Superplastic forming can and has been viewed as an accelerated form of high temperature creep and occurs much like sagging or creep forming. In the case of aluminum alloys, superplastic forming is normally performed at temperatures above 700° F., typically in the range of about 900 to 1000° F. or even higher. At these temperatures, the metal creeps and can be moved by shaping operations at relatively low stress levels, the stress at which metal starts to move easily or "flow" being referred to as the flow stress.

Superplastic forming is recognized as being able to produce intricate forms or shapes from sheet metal and offers the promise of cost savings through opportunity for parts consolidation. Superplastic-forming techniques, however, are themselves time-consuming in that like any form of creep forming, the metal flowing operation proceeds relatively slowly in comparison with high speed press forming. Substantial cost savings and benefits could be realized if a superplastically formed, aluminum alloy could be made to flow faster at a given temperature, or be superplastically formed at a lower temperature, or both, without localized necking, tearing or rupturing.

Fine grain size, a prerequisite for good SPF properties, is generally obtained by manipulating both nucleation and growth of recrystallized grains in the cold rolled (CR) sheets. Ideally, many nucleation centers to form many recrystallized grains coupled with sufficient pinning sources to prevent grain growth are prerequisites to obtain fine grains. Al-3 wt. % Mg alloys, in our example, utilize similar dispersoid additions as the 4.5 wt. % Mg alloys and higher, for example 6 wt. % Mg, or even up to about 10 wt. % Mg. Thus, they have the requisite pinning centers to prevent grain growth. Nucleation wise though all the alloys had undergone identical deformation, it is likely that at the 3 wt. % Mg level the density of dislocation networks which increases with increasing Mg was inadequate, thus resulting in less development of nucleation sources for recrystallized grains. Thus, it appeared that the improved SPF performance of the Al-3 wt. % Mg alloy was intimately related to its ability to develop finer grains through the formation of more recrystallization nuclei made possible through some new approach.

The current invention attempts to overcome the low solute handicap in lower magnesium level, aluminum-based alloys. By incorporating Si (and/or Cu when corrosion is not a concern) into solid solution, the density of tangled dislocations could be increased during TMP to a level similar to that of higher Mg alloys. This would then provide more nucleation centers for recrystallized grains. On a preferred basis, Si is added to Al-3 wt. % Mg alloys to its maximum solubility limit. However, the solubility of Si (and Cu, to an extent) is drastically reduced in aluminum alloys containing greater than 1 wt. % Mg. Thus, the amount of Si that could be added to an Al-3 wt. % Mg composition was 0.18%, corresponding to the highest possible SHT temperature of 1080° F. per equilibrium diagram information. In addition, combinations of dispersoid formers Mn, Cr and/or Zr were added.

The final composition of a test, book mold ingot (2.0"×10"×14") was: Mg: 3.13 wt. %; Si: 0.22 wt. %; Mn: 0.78 wt. %; Cr: 0.19 wt. %; Zr: 0.10 wt. %; Fe: 0.05 wt. %; Be: 0.0004 wt. %;, the balance aluminum. The scalped ingot was heated to 830° F. in 15 hours, soaked for 4 hours at 830° F., and hot rolled in four passes to a 0.6" finish gauge plate. The plate was then solution treated at 1080° F. for 1 hour, cold water quenched (CWQ) and cold rolled (in 10 passes) to an 80% reduction (or to 0.12") or, alternatively to an 88% reduction (0.072" gauge sheet).

SPF tests were performed on these sheet products by rapidly heating the samples in 15 minutes to SPF test temperatures of 1000 or 1050° F. Failure samples were then taken for metallographic examination of their grain structures. The actual SPF tests followed the normal procedures of first determining the strain rate sensitivity parameter (m) as a function of strain rate, and then determining the elongation at selected constant strain rates corresponding to the highest or optimized high "m" values. In this investigation, strain rates varied from 0.003 to 0.0003/sec and the corresponding "m" values from 0.35 to 0.45, respectively.

It may be noted that apart from the Si addition, another important prerequisite noted for this invention was the implementation of a drastic cooling rate, preferably achieved via contact with a cold liquid medium, most preferably cold water, after a 1080° F. solution heat treatment in order to retain solute supersaturation and take advantage of same during subsequent cold rolling steps. This contrasts with standard practices which use air cooling of hot rolled plate followed by direct cold rolling or low temperature annealing. The additional solute retained by CWQ leads to increased solute interaction effects due to Si. In subsequent stages, the much reduced solubility of Si at high Mg compositions was exploited to its best advantage. The excess Si formed many fine $Mg_2Si$ precipitates at lower temperature during the heat up for SPF. This resulted in added dispersoids effect which contributed to further grain growth control.

Figure 1B:
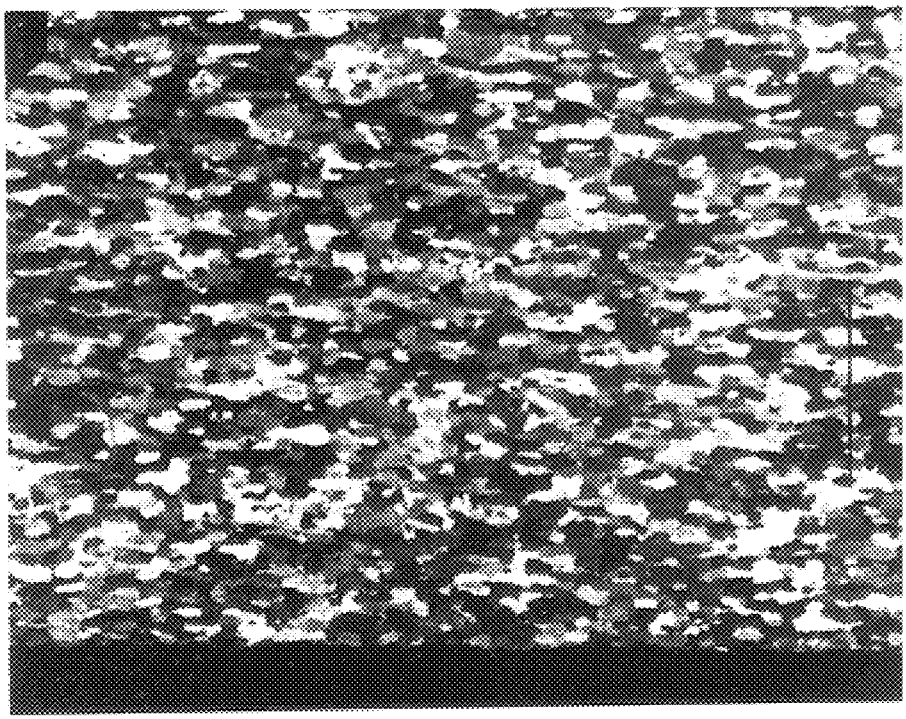

With respect to the accompanying Figures, polarized light optical micrograph data illustrates several noteworthy changes in the microstructure that accompanied the progress of SPF in the preferred, lower Mg, Al—Si alloys of this invention. FIGS. 1A and 1B show micrographs at Grip versus Gauge sections, respectively, for a 0.1" sample tested at 1000° F. and 0.0003/sec to indicate the effect of strain induced grain growth at Gauge. The Gauge was exposed to both high (SPF) temperature and strain while Grip to just high temperature exposure. Comparing with FIG. 1A (using strain rate 0.001/sec), the grain size in FIG. 1B appears somewhat coarser which indicates the effect of a slower strain rate in the latter, i.e. longer time available for strain induced growth.

Figure 2:
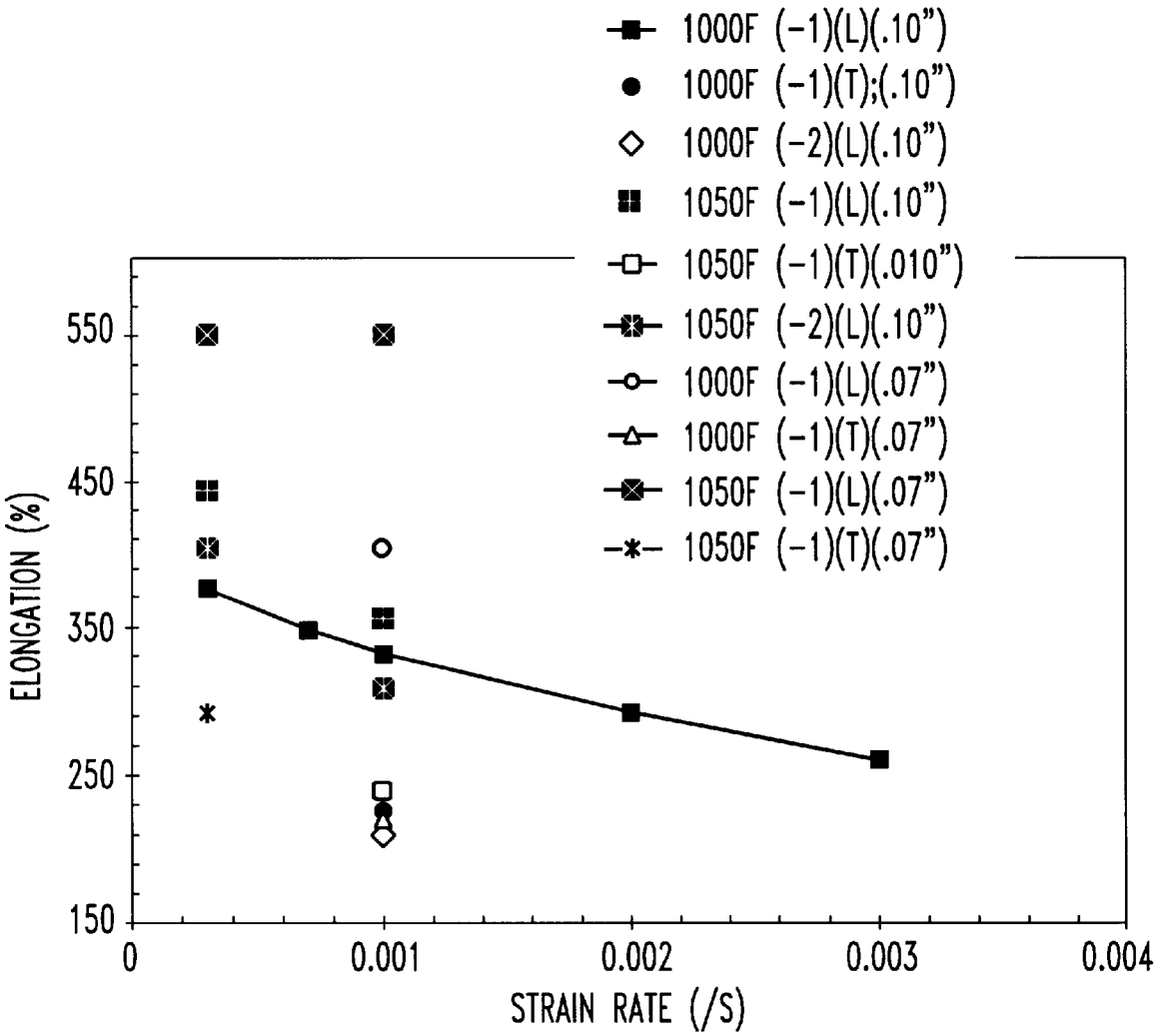
FIG. 2 is a chart showing the relative relationship of strain rate (x-axis) versus % elongation (y-axis) for one preferred alloy composition according to this invention.

FIG. 2 shows a composite plot of results in terms of SPF elongation (EL) versus strain rate (SR) at two different test temperatures (1000 and 1050° F.), and for two sheet gauges (0.1 and 0.07"), that corresponded to 80 and 88% cold roll reductions, respectively. Comparing these results with those previously observed for sheets with the same 80% cold reduction, and tested under identical conditions of 1000° F. and a 0.002/sec strain rate, the longitudinal SPF elongation values increased from 208 to 292%. Thus, the new approach of this invention increases comparative elongations by nearly 40%.

this invention, both Si additions and CW quenching, when combined with additional optimization measures (increased cold rolling and higher SPF test temperatures) succeed in increasing overall SPF elongations in an Al-3 wt. % Mg alloy by more than 160% from its original 208% to greater than 550%.

In a comparative experiment, samples were solution heat treated at a lower temperature, 950° F., and quenched to intentionally reduce the solubility of Si in the matrix. This was predicted to correspondingly decrease the overall nucleation effect during deformation. The SPF elongation results dropped from 332 to 216% in agreement with said prediction.

Figure 3A:
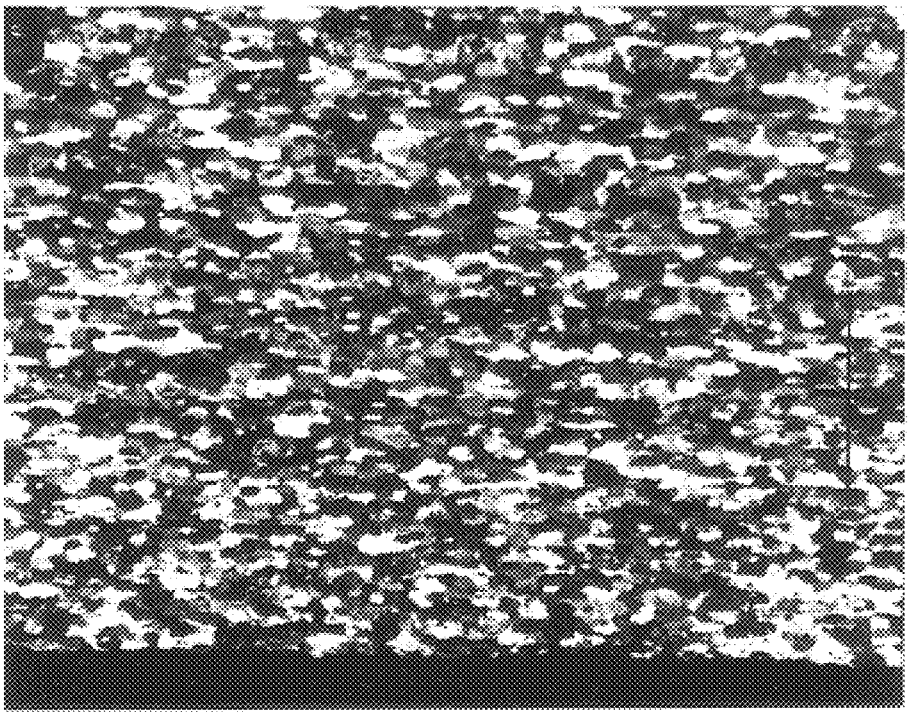
FIGS. 3A and 3B are polarized light optimal micrographs (100× magnification) comparing the grain structures of a 0.10 inch thick, superplastically formed sheet product according to this invention tested at 1000° F.

Optical metallography of SPF-formed Al-3 wt. % Mg-Si samples in FIG. 3A show the presence of fine, uniformly recrystallized grains, thus meeting this invention's first objective of grain size refinement. The detailed SPF results are listed in Table 1 that follows.

TABLE 1

SPF Elongation Values as Functions of Strain Rate, Temperature and Sheet Gauge in an A1-3 Mg-0.2 Si Alloy according to the Invention

| Strain Rate | (/1000F(−1)(L)(.10") | (/1000F(−1)(T);(.10") | (/1000F(−2)(L)(.10") |
|---|---|---|---|
| 0.0003 | 376 | | |
| 0.0007 | 348 | | |
| 0.001 | 332 | 224 | 216 |
| 0.002 | 292 | | |
| 0.003 | 260 | | |
| **Strain Rate** | **(/1050F(−1)(L)(.10")** | **(/1050F(−1)(T);(.10")** | **(/1050F(−2)(L)(.10")** |
| 0.0003 | 444 | | 404 |
| 0.0007 | | | |
| 0.001 | 356 | 236 | 308 |
| **Strain Rate** | **(/1000F(−1)(L)(.07")** | **(/1000F(−1)(T)(.07")** | |
| 0.0003 | | | |
| 0.0007 | | | |
| 0.001 | 404 | 224 | |
| **Strain Rate (/** | **1050F(−1)(L)(.07")** | **1050F(−1)(T)(.07")** | |
| 0.0003 | >550 | 292 | |
| 0.0007 | | | |
| 0.001 | >550 | | |

FIG. 2 also shows the general trend of increasing elongation as strain rate decreases from 0.002/sec to 0.0003/sec. Thus, for example, the elongation increased from 292% at 0.002/sec to 376% at 0.0003/sec for 80% cold rolled sheet at 1000° F. However, since higher strain rates are generally more attractive to manufacturers, especially automotive sheet part manufacturers, most of the SPF data in FIG. 2 was collected for a 0.001/sec strain rate.

Figure 3B:
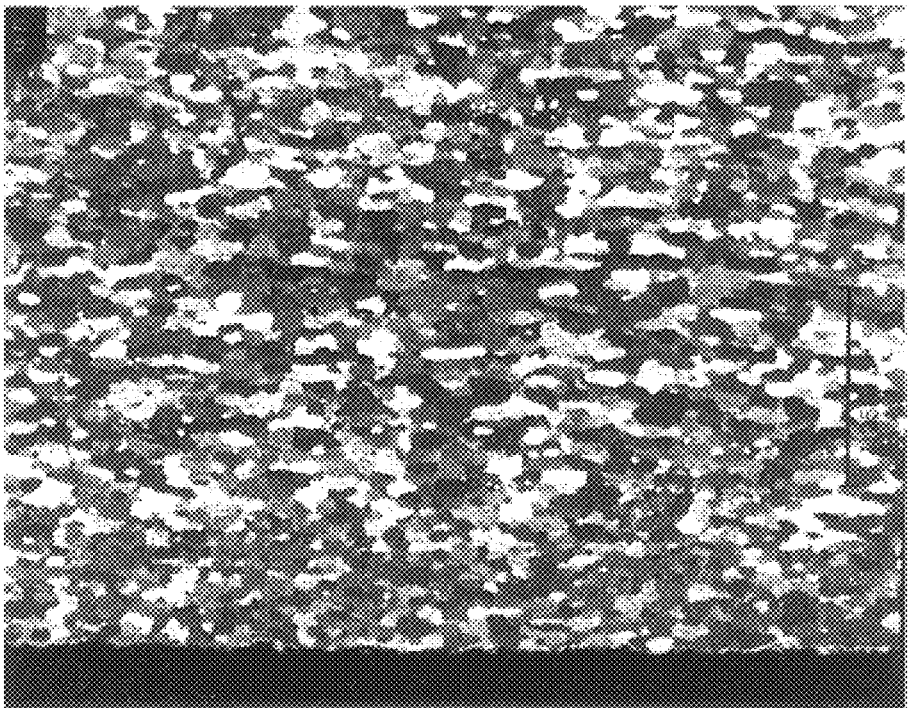

FIG. 2 also shows the several higher SPF elongation values obtained in samples through further TMP optimization. Thus, at a strain rate of 0.001/sec, increasing the SPF test temperature from 1000 to 1050° F. increased elongation from 332 to 356%, while increasing the cold reduction from 80% to 88% increased elongation at 1000° F. from 332 to 404%. A sample of 0.072" gauge when tested at 1050° F., at either 0.001/sec or at 0.0003/sec, did not fail up to a 550% elongation limit imposed by the maximum setting of the cross head motion. Thus, the preferred new approaches of FIG. 3B shows the effect of temperature, where the gauge micrograph shows coarser grains for a test temperature of 1050° F. compared to the micrograph for 1000° F. in FIG. 3A (both using the strain rate 0.001/sec).

Figure 4A:
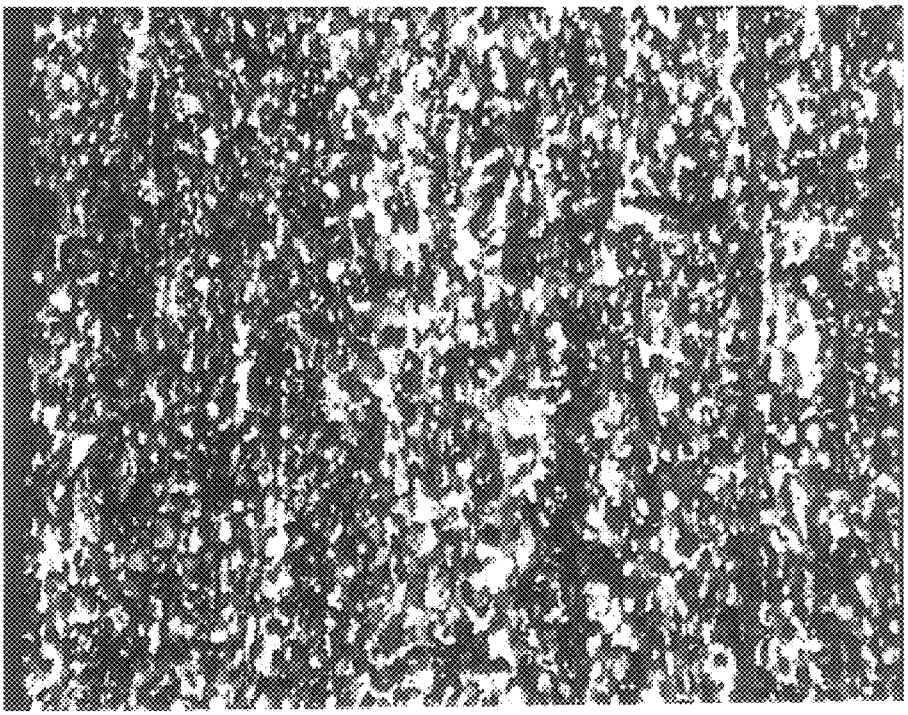
FIGS. 4A and 4B are polarized light optimal micrographs (100× magnification) comparing the grain structures of a 0.07 inch thick, superplastically formed sheet product according to this invention tested at 1000° F. and a strain rate of 0.001/sec. to show the effect of cold rolling thereon, FIG. 4A being at Grip and FIG. 4B at Gauge, respectively.
Figure 4B:
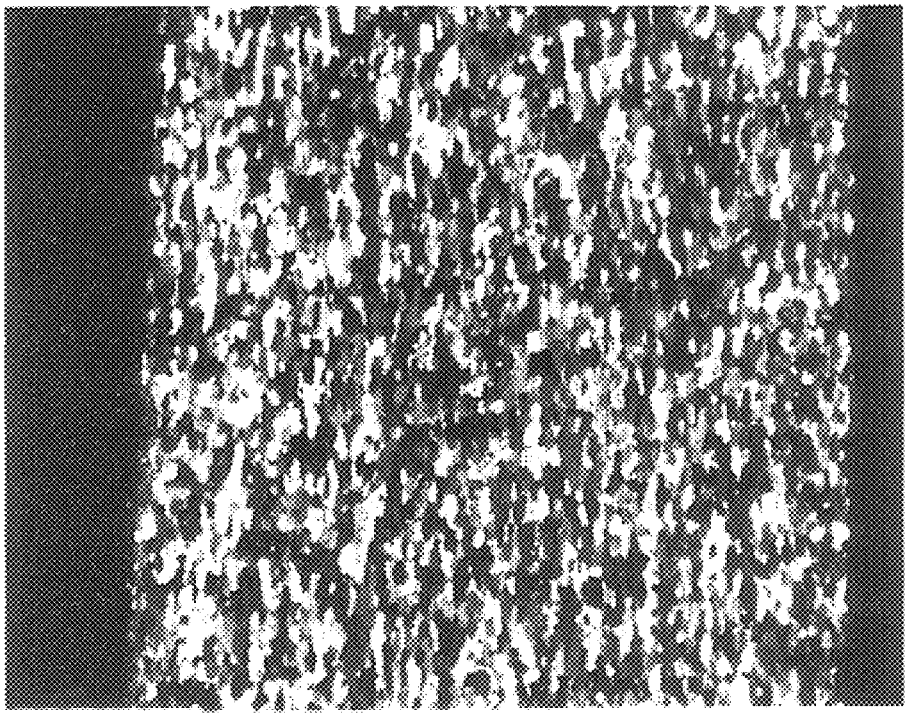

FIGS. 4A and 4B show the micrographs at Gauge and Grip, respectively, for the 0.07" gauge sheet pulled at 1000° F. and 0.001/sec, indicating that higher cold reduction resulted in further grain refinement commensurate with further increase in elongation, 404% compared to 332% for 0.10" sheets.

Because of the foregoing performance, it is believed that sheet product compositions processed according to this invention would achieve the desired SPF properties, with improved corrosion resistance performance and sufficient strength values as to warrant the manufacture of both inner and outer automotive structural sheet parts therefrom.

Having described the presently preferred embodiments, it is to be understood that the invention may be otherwise embodied by the scope of the claims appended hereto.

What is claimed is:

1. A superplastically formable, aluminum alloy product which consists essentially of: about 2–3.8 wt. % magnesium; at least one dispersoid-forming element selected from the group consisting of: up to about 1.6 wt. % manganese, up to about 0.2 wt. % zirconium, and up to about 0.3 wt. % chromium; at least one nucleation-enhancing element for recrystallization selected from: between about 0.1–1.0 wt. % silicon, up to about 0.8 wt. % copper, and combinations thereof, the balance incidental elements and impurities, said alloy product having greater than about 225% elongation at a strain rate of at least about 0.0003/sec and a superplastic forming temperature between about 950–1135° F. from having been, after hot rolling to an intermediate gauge, solution heat treated at one or more temperatures between about 1000–1000° F., quenched at a drastic cooling rate and cold rolled to greater than about 60% reduction without intermediate annealing.

2. The alloy product of claim 1 which has been quenched through contact with a cold liquid.

3. The alloy product of claim 1 which has been cold water quenched.

4. The alloy product of claim 1 which has been fast air cooled.

5. The alloy product of claim 1 which has been cold rolled to between about 75–90% reduction.

6. The alloy product of claim 1 which contains about 2.7–3.2 wt. % magnesium.

7. The alloy product of claim 1 which has improved corrosion resistance and is substantially copper-free.

8. The alloy product of claim 7 which contains about 0.13–0.23 wt. % silicon.

9. The alloy product of claim 1 which has greater than about 300% elongation at said strain rate and superplastic forming temperature range.

10. The alloy product of claim 9 which has greater than about 400% elongation at said strain rate and temperature range.

11. The alloy product of claim 10 which has greater than about 500% elongation at said strain rate and temperature range.

12. An automotive sheet product made from a substantially copper-free, iron-free, superplastically formable, aluminum alloy which contains about 2–3.8 wt. % magnesium, at least one dispersoid-forming element selected from the group consisting of: up to about 1.6 wt. % manganese, up to about 0.2 wt. % zirconium, and up to about 0.3 wt. % chromium; about 0.1–1.0 wt. % silicon, the balance incidental elements and impurities, said sheet product having improved corrosion resistance and greater than about 225% elongation at a strain rate of at least about 0.0003/sec and a temperature between about 950–1135° F. from having been, after hot rolling to an intermediate gauge, solution heat treated at one or more temperatures between about 1000–1100° F., quenched at a drastic cooling rate and cold rolled to greater than about 60% reduction without intermediate annealing.

13. The automotive sheet product of claim 12 which has been cold water quenched.

14. The automotive sheet product of claim 12 which has been cold rolled to between about 75–90% reduction.

15. The automotive sheet product of claim 12 which contains about 2.7–3.2 wt. % magnesium.

16. The automotive sheet product of claim 12 which contains about 0.13–0.23 wt. % silicon.

17. The automotive sheet product of claim 12 which has greater than about 300% elongation at said strain rate and superplastic forming temperature range.

18. The automotive sheet product of claim 17 which has greater than about 400% elongation at said strain rate and temperature range.

19. The automotive sheet product of claim 18 which has greater than about 500% elongation at said strain rate and temperature range.

* * * * *

UNITED STATES PATENT AND TRADEMARK OFFICE

CERTIFICATE OF CORRECTION

PATENT NO. : 6,063,210
DATED : May 16, 2000
INVENTOR(S) : Dhruba J. Chakrabarti et al.

It is certified that error appears in the above-identified patent and that said Letters Patent is hereby corrected as shown below:

Column 2,
Line 42, change "optimal" to -- optical --.

Column 2,
Line 51, change "optimal" to -- optical --.

Column 7,
Line 16, change "1000 - 1000°F" to -- 1000-1100°F --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*